US005921692A

United States Patent [19]

Weber

[11] Patent Number: 5,921,692

[45] Date of Patent: Jul. 13, 1999

[54] DENTIFRICE MATERIAL DISPENSING AND REFILLING SYSTEM

[76] Inventor: Miriam Weber, 240 Windward Passage #604, Clearwater, Fla. 34630-8882

[21] Appl. No.: 08/821,860

[22] Filed: Mar. 21, 1997

[51] Int. Cl.[6] ..... B43K 11/02

[52] U.S. Cl. ..... 401/119; 401/184; 401/191

[58] Field of Search ..... 141/18; 222/387; 401/184, 119, 191

[56] References Cited

U.S. PATENT DOCUMENTS

| | | | |
|---|---|---|---|
| 243,884 | 7/1881 | Gulden | 222/387 |
| D. 347,944 | 6/1994 | Honora | D4/108 |
| D. 355,074 | 2/1995 | Devecchio et al. | D4/108 |
| D. 357,124 | 4/1995 | Greenhouse et al. | D4/108 |
| D. 368,374 | 4/1996 | Ashcraft | 401/184 X |
| 988,422 | 4/1911 | Wilson | 222/387 X |
| 1,448,943 | 3/1923 | Rogers | 401/184 |
| 2,277,437 | 3/1942 | Hultgren et al. | 141/18 X |
| 2,699,889 | 1/1955 | Johnson | 141/18 X |
| 2,743,042 | 4/1956 | Burgin | 401/184 X |
| 3,132,772 | 5/1964 | Bristow | 222/387 X |
| 5,346,324 | 9/1994 | Kuo | 401/146 |
| 5,403,105 | 4/1995 | Jameson | 401/45 |
| 5,407,287 | 4/1995 | Braun et al. | 401/176 |
| 5,439,014 | 8/1995 | Moussa | 132/311 |

FOREIGN PATENT DOCUMENTS

| | | | |
|---|---|---|---|
| 2379266 | 10/1978 | France | 401/184 |

*Primary Examiner*—Steven A. Bratlie
*Attorney, Agent, or Firm*—Joseph N. Breaux

[57] ABSTRACT

A dispensing and refilling system for dispensing and refilling dentifrice material comprising a dispensing toothbrush having a hollow cavity and a refilling apparatus for refilling the dentifrice material in the dispensing toothbrush. The refilling apparatus comprises a dentifrice material reservoir for housing therein the dentifrice material, a nozzle detachably coupled to the dentifrice material reservoir, and a pumping assembly for applying a force of pressure to the dentifrice material. As the force of pressure is applied to the dentifrice material, the dentifrice material exits refilling apparatus and enters the hollow cavity. The refilling apparatus has a mechanism for clasping the detachable nozzle when not in use.

1 Claim, 2 Drawing Sheets

DENTIFRICE MATERIAL DISPENSING AND REFILLING SYSTEM

TECHNICAL FIELD

The present invention relates to dentifrice material dispensing and refilling system and more particularly to a dentifrice material dispensing and refilling system comprising a push-button dentifrice material dispensing toothbrush and a dentifrice material refilling apparatus for quickly and easily refilling the dentifrice material in the push-button dispensing toothbrush.

BACKGROUND OF THE INVENTION

Typically, toothpaste dispensing toothbrushes comprise a hollow cavity for storing therein dentifrice material which is distributed into the bristles of the toothbrush. In some instances the hollow cavity is refilled with dentifrice material, as described in U.S. Pat. No. 5,439,014, by Moussa or U.S. Pat. No. 5,403,105, by Jameson. Otherwise, the toothpaste dispensing toothbrushes receive a replaceable toothpaste cartridge, as described in U.S. Pat. No. 5,346,324, by Kuo, or the toothpaste dispensing toothbrush is disposed of after the dentifrice material is used up, as described in U.S. Pat. No. 5,407,287, by Praun et al.

In order to refill the hollow cavities, of refillable dispensing toothbrushes with dentifrice material, the dentifrice material stored in a squeezable and collapsible tube is injected into such hollow cavities. The use of such squeezable and collapsible tube to refill the hollow cavities of the known the toothpaste dispensing toothbrushes require one hand, of the user, to hold the toothbrush and the other hand to hold said tube. Therefore, it is cumbersome to further squeeze the tube for the transfer of dentifrice material into the hollow cavity. Moreover, during the refilling process (because the squeezable and collapsible tube in combination with the dispensing toothbrush are cumbersome to use together) a significant amount of dentifrice material is left unrecovered in such squeezable and collapsible tube.

It can be readily seen that the known dentifrice material dispensing and refilling systems do not address the continuing need for a push-button toothpaste dispensing toothbrush and a toothpaste refilling apparatus for quickly and easily refilling the toothpaste in the push-button toothpaste dispensing toothbrush.

SUMMARY OF THE INVENTION

The preferred embodiment of the dentifrice material dispensing and refilling system of the present invention solves the aforementioned problems in a straight forward and simple manner. What is provided is a dentifrice material dispensing and refilling system comprising a push-button toothpaste dispensing toothbrush and a refilling apparatus for quickly and easily refilling the dentifrice material in the push-button dispensing toothbrush.

The dispensing and refilling system for dispensing and refilling dentifrice material comprises a dispensing toothbrush having a hollow cavity and a refilling apparatus for refilling the dentifrice material in the dispensing toothbrush. The refilling apparatus comprises a dentifrice material reservoir for housing therein the dentifrice material, a nozzle detachably coupled to the dentifrice material reservoir, and a pumping assembly for applying a force of pressure to the dentifrice material. As the force of pressure is applied to the dentifrice material, the dentifrice material exits refilling apparatus and enters the hollow cavity.

In view of the above an object of the invention is to provide a dentifrice material dispensing and refilling system having a push-button toothpaste dispensing toothbrush which is adapted to receive a detachable nozzle of a toothpaste refilling apparatus for refilling dentifrice material in a hollow cavity of said toothbrush.

Another object of the invention is to provide a toothpaste dispensing toothbrush which dispenses dentifrice material into the bristles of said toothbrush by applying a force of pressure to a bladder-type push-button. Moreover, dentifrice material can be readily reapplied easily and effortlessly to the bristles, while the user is brushing his/her teeth, by reapplying a force of pressure to the bladder-type push-button.

A further object of the invention is to provide a toothpaste dispensing toothbrush having a plunger assembly for minimizing the amount of dentifrice material residue within the hollow cavity of the toothpaste dispensing toothbrush when the dentifrice material is compressed to force such dentifrice material into a conduit.

It is a still further object of the invention to provide a dentifrice material dispensing and refilling system having a toothpaste refilling apparatus which minimizes the amount of dentifrice material residue in then toothpaste refilling apparatus.

It is a still further object of the invention to provide a toothpaste refilling apparatus which is supported upright whereby dentifrice material slides downward by the force of gravity for maximizing the collection pool of the dentifrice material in the bottom of the toothpaste refilling apparatus for the quick transfer of such dentifrice material.

It is a still further object of the invention to provide a toothpaste refilling apparatus having a detachable nozzle which is easily cleaned to eliminate any buildup of dentifrice material therein. Moreover, since the detachable nozzle is cleaned between refills, the user is guaranteed a fresh supply of dentifrice material for storage in the push-button toothpaste dispensing toothbrush.

It is a still further object of the invention to provide a detachable nozzle which is easily stored away for future use via a clasping means coupled to the toothpaste refilling apparatus thereby preventing misplacement of the detachable nozzle between refills.

It is a still further object of the invention to provide a toothpaste refilling apparatus which is compact.

It is a still further object of the invention to provide a toothpaste refilling apparatus having a pumping assembly which applies a force of pressure to the collection pool of dentifrice material for the quick transfer of the dentifrice material to the toothpaste dispensing toothbrush.

It is a still further object of the invention to provide a toothpaste refilling apparatus which is capable of being used with non-dispensing toothbrushes.

In view of the above objects, a feature of the present invention is to provide a toothpaste refilling apparatus which is inexpensive and simple to manufacture.

Another feature of the present invention is to provide a push-button toothpaste dispensing toothbrush which is refillable and inexpensive and simple to manufacture.

A further feature of the present invention is to provide a push-button toothpaste dispensing toothbrush and toothpaste refilling apparatus which are both easy to use.

The above objects and other features of the present invention will become apparent from the drawing, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
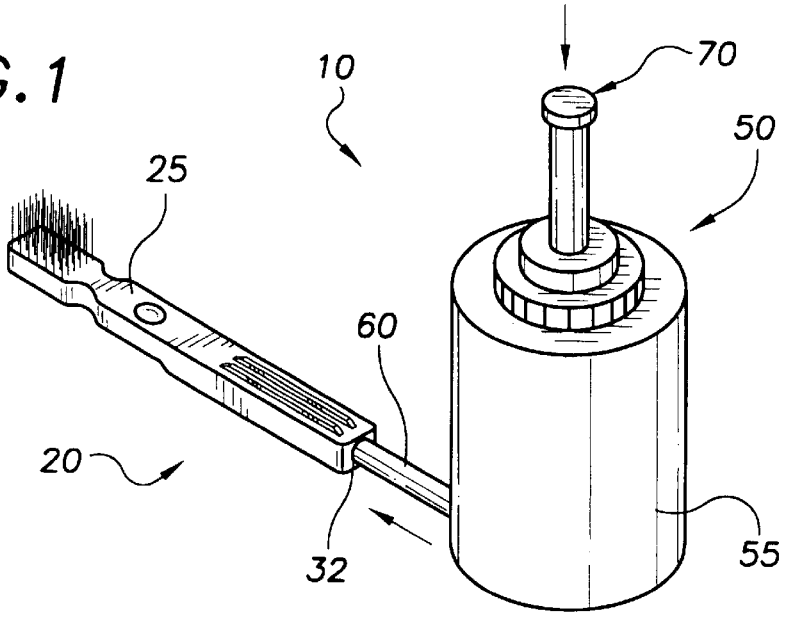
FIG. 1 illustrates a perspective view of the dentifrice material dispensing and refilling system of the present invention.

Referring now to the drawings, and in particular FIG. 1, the dentifrice material dispensing and refilling system of the present invention is designated generally by the numeral 10. Dentifrice material dispensing and refilling system 10 is comprised of push-button dispensing toothbrush 20 and refilling apparatus 50.

Figure 2:
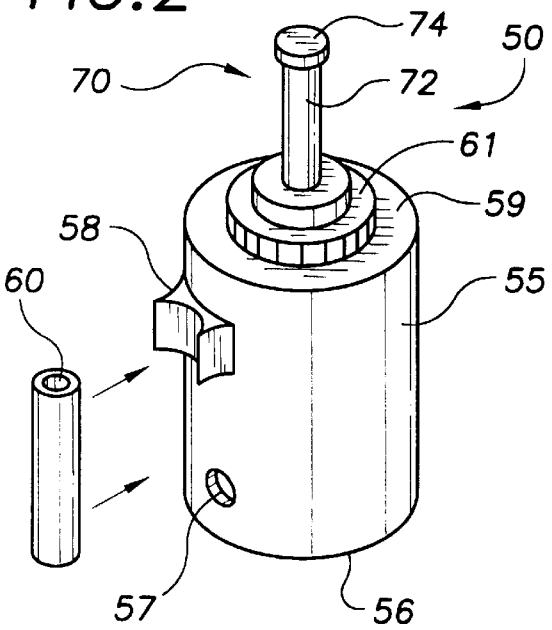
FIG. 2 illustrates a perspective view of the refilling apparatus, showing the detachable nozzle parallel to the clasping means of the embodiment of FIG. 1.
Figure 3:
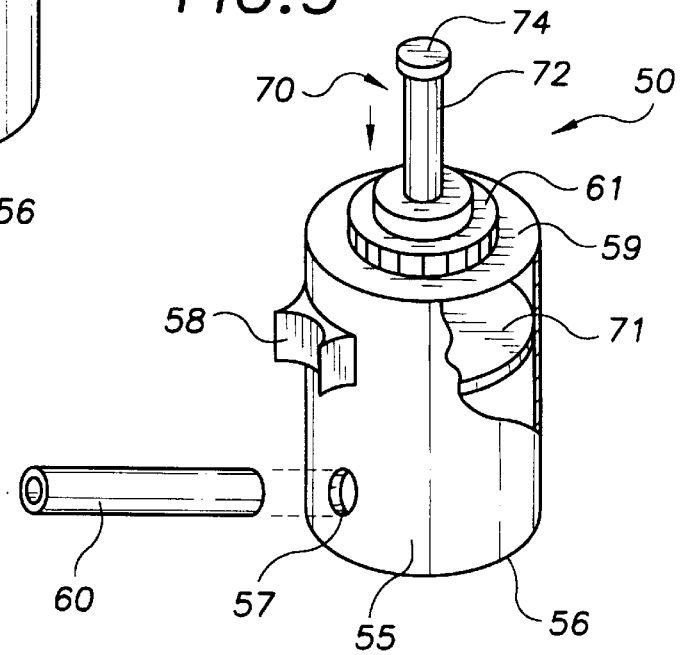
FIG. 3 illustrates a perspective view of the refilling apparatus having a cut-away portion showing the pumping assembly of the present invention.

Referring to FIGS. 2 and 3, refilling apparatus 50 is generally comprised of dentifrice material reservoir 55, detachable nozzle 60, and pumping assembly 7. Dentifrice material reservoir 55 is a hollow cylindrically shaped structure having bottom support surface 56 for maintaining dentifrice material reservoir 55 in an upright position. Such upright position enables the dentifrice material stored in dentifrice material reservoir 55 to slide downward by the force of gravity when the dentifrice material reservoir 55 is idle and stored away. Henceforth, the amount of dentifrice material residue remaining in dentifrice material reservoir 55 is significantly minimized and the time to transfer dentifrice material from dentifrice material reservoir 55 to push-button dispensing toothbrush 20 is minimized. Although in the exemplary embodiment the dentifrice material reservoir 55 is a hollow cylindrically shaped structure, any geometrically shaped structure having a bottom support surface may be substituted.

Dentifrice material reservoir 55 comprises transfer outlet aperture 57 for receiving therein one distal end of detachable nozzle 60. Transfer outlet aperture 57 is formed in the longitudinal surface of said hollow cylindrically shaped structure in close proximity to bottom surface 56 for maximizing the complete transfer of the dentifrice material contents stored in dentifrice material reservoir 55 via detachable nozzle 60. For enhanced securing of detachable nozzle 60 in transfer outlet aperture 57, said one distal end of detachable nozzle 60 and transfer outlet aperture 57 may both be threaded whereby detachable nozzle 60 may be screwably secured in transfer outlet aperture 57.

The vertical enclosing surface of dentifrice material reservoir 55 has coupled thereto clasp means 58 for securing thereto detachable nozzle 60, a hollow tubular member, when toothpaste refilling apparatus 50 is not in use. Clasp means 58 is a semicircular structure having a clasping grip for holding detachable nozzle 60 when detachable nozzle 60 is snapped therein.

Pumping assembly 70 comprises geometrically shaped member 71, rod member 72, and pressure point member 74. The geometrically shaped member 71 has a tight seal with an interior surface of dentifrice material reservoir 55. Rod member 72 is fixedly coupled to the center of geometrically shaped member 71 and has a length which is at least the length of dentifrice material reservoir 55. Pressure point member 74 is fixedly coupled to one distal end of rod member 72 wherein, as the user applies a force of pressure to pressure point member 74, geometrically shaped member 71 applies a force of pressure to the dentifrice material. As the force of pressure is applied to the dentifrice material, the dentifrice material spreads and exits transfer outlet aperture 57. As the dentifrice material exits transfer outlet aperture 57, the dentifrice material is forced into detachable nozzle 60. Top surface 59 has coupled thereto a removable lid member 61 which has formed therein a centrally located aperture for receiving therein rod member 72.

Figure 4:
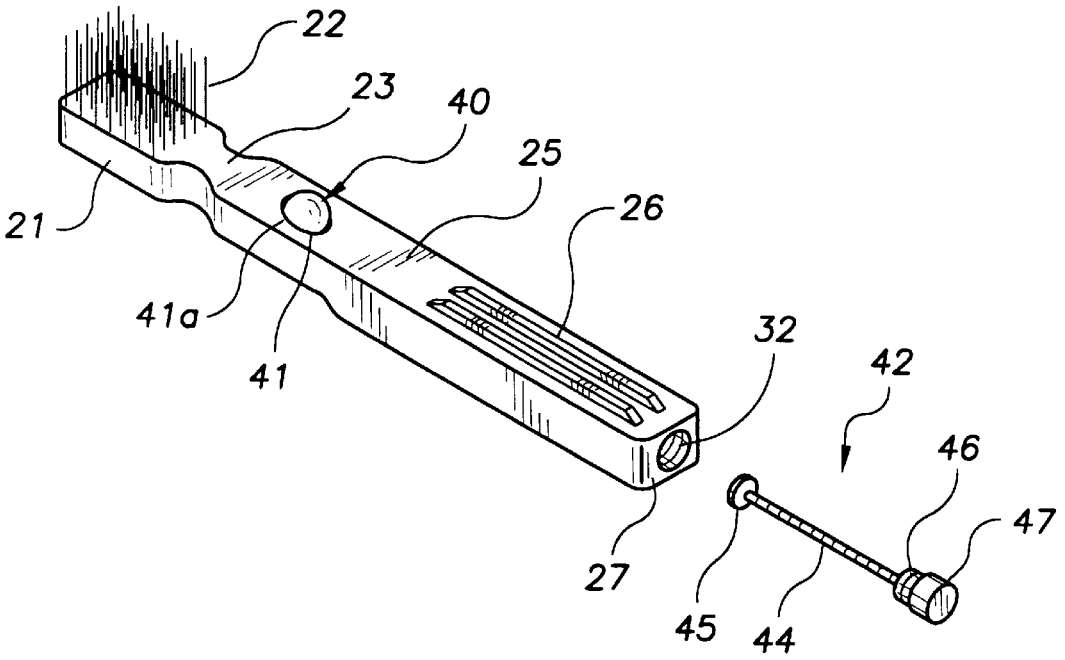
FIG. 4 illustrates an exploded view of the push-button dispensing toothbrush of the embodiment of FIG. 1.
Figure 5:
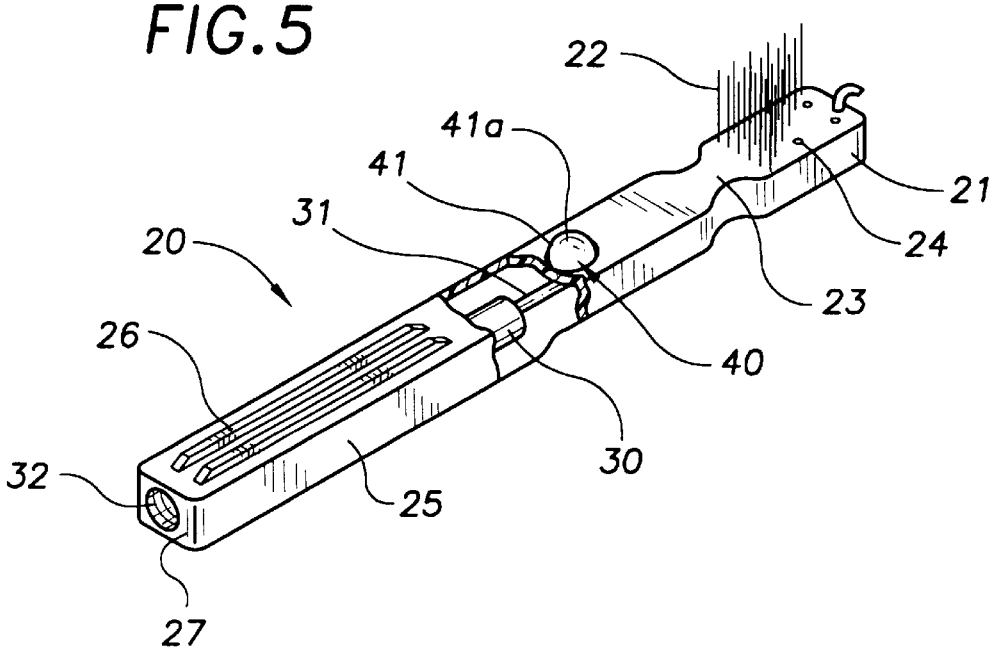
FIG. 5 illustrates a perspective view of the push-button dispensing toothbrush having a cut-away portion showing the hollow cavity and the conduit of the embodiment of FIG. 1.

Referring to FIGS. 4 and 5, push-button toothbrush 20 comprises toothbrush head 21, a plurality of bristles 22, toothbrush neck 23 and toothbrush handle 25. Toothbrush head 21 is a substantially flat rectangular member having the plurality of bristles 22 implanted therein and radially projected perpendicularly upward therefrom, such that the plurality of bristles 22 are equally spaced in a plurality of rows. The plurality of bristles 22 are made of plastic, such as nylon or the like. Additionally, the height of each of the plurality of bristles 22 may be substantially equal or the height of the bristles in alternating rows of said plurality of rows may be slightly higher. The plurality of bristles 22 have a sufficient density to obtain a good massaging and cleaning effect. Toothbrush head 21 has formed therein, between the plurality of bristles 22, a plurality of dispensing apertures 24 for exiting therefrom dentifrice material into the plurality of bristles 22.

Toothbrush handle 25 is a rectangular shaped member having formed therein hollow cavity 30 for storing therein dentifrice material. Nevertheless, toothbrush handle 25 may be any shape suitable for griping. At least the top surface of toothbrush handle 25 comprises a plurality of raised ridges 26 for enabling the user to maintain a firm grip around toothbrush handle 25. One distal end of hollow cavity 30 fixedly couples to conduit 31 which extends from a portion of toothbrush handle 25 into toothbrush head 21 via toothbrush neck 23.

Push-button dispensing toothbrush 20 further comprises dentifrice material dispensing means 40 and dentifrice material compressing means 42. Dentifrice material dispensing means 40 comprises bladder-type push-button 41 having air hole 41*a* for dispensing dentifrice material into the plurality of bristles 22 via the plurality of dispensing apertures 24.

Dentifrice material compressing means 42 comprises dispensing worm screw 44, plunger 45, threaded cap means 46 and dispensing knob 47. The other distal end of hollow cavity 30 comprises threaded inlet aperture 32 which is integral with handle end surface 27 of toothbrush handle 25. Threaded inlet aperture 32 matingly receives therein threaded cap means 46 whereby, when dentifrice material compressing means 42 is removed, dentifrice material of the users choice enters hollow cavity 30 via the opening of threaded inlet aperture 32. Threaded cap means 46 and dispensing knob 47 are coupled to one distal end of dispensing worm screw 44. Dispensing knob 47, which is disc shaped, abuts against the exterior surface of handle end surface 27. Plunger 45, which is disc shaped, forms a tight seal with the interior surface of hollow cavity 30 wherein, as plunger 45 moves farther into hollow cavity 30 along dispensing worm screw 44, the dentifrice material is compressed therein and forced into conduit 31. The tight seal minimizes the amount of dentifrice material residue left in hollow cavity 30.

Dispensing worm screw 44 has a length that is less than the length of hollow cavity 30 such that dispensing worm screw 44 ends prior to conduit 31 thereby providing an unobstructed path for the dentifrice material to enter conduct 31. Plunger 45, threaded cap means 46 and dispensing knob 47 are concentrically coupled about the axis of dispensing worm screw 44. Accordingly, when dispensing knob 47 is rotated counterclockwise dispensing worm screw 44 rotates. Likewise, plunger 45 rotates counterclockwise and moves in a forward direction along dispensing worm screw 44 thereby applying a force of pressure to the dentifrice material stored in hollow cavity 30. As said force, of pressure is applied to the dentifrice material, the dentifrice material is pushed through conduit 31. As conduit 31 fills with dentifrice material, the bladder-type push-button 41 fills with dentifrice material, too. Henceforth, the user presses bladder-type push-button 41 to the dispense dentifrice material out through the plurality of dispensing apertures 24 and into the plurality of bristles 22. As needed, the user may press bladder-type push-button 41 to dispense dentifrice material into the plurality of bristles after bladder-type push-button 41 pops out via a force of air. Such air enters via air hole 41a formed in bladder-type push-button 41.

The following description will be referring to the operation, of dentifrice material dispensing and refilling system 10 of the present invention. Initially, hollow cavity 30 should be filled with the dentifrice material of the users choice via refilling apparatus 50. In doing so, detachable nozzle 60 is unclasped from clasping means 58 and is coupled to transfer outlet aperture 57 of refilling apparatus 50. Then, dentifrice material compressing means 42 is unscrewed via threaded cap means 46 and removed. Thereafter, detachable nozzle 60 of refilling apparatus 50 is coupled to threaded inlet aperture 32. Push-button dispensing toothbrush 20 may be maintained horizontally.

The dentifrice material is transferred from refilling apparatus 50 to hollow cavity 30 of push-button dispensing toothbrush 20 as pumping assembly 70 applies a force of pressure to the dentifrice material stored in dentifrice material reservoir 50. After hollow cavity 30 is filled to capacity, dentifrice material compressing means 42 is screwed into place via threaded cap means 46 thereby preventing the dentifrice material from drying out and maintaining freshness and detachable nozzle 60 is cleaned.

When the user desires to brush his or her teeth, dispensing knob 47 is turned counterclockwise thereby moving plunger 45 in a forward direction. As plunger 45 moves in said forward direction along dispensing worm screw 44, pressure is applied to the dentifrice material stored in hollow cavity 30 and compresses it. Accordingly, the compressed dentifrice material, under pressure, moves into conduit 31. To dispense the dentifrice material into the plurality of bristles 22, the user presses bladder-type push-button 41. From time to time, while brushing, the user may re-dispense the dentifrice material into the plurality of bristles 22 by pressing bladder-type push-button 41. As needed, the dentifrice material is replenished in hollow cavity 30 via refilling apparatus 50, in the same manner as described above.

It can be seen from the preceding description that a dentifrice material dispensing and refilling system for quickly and easily refilling the dentifrice material in the push-button dispensing toothbrush via a refilling apparatus has been provided.

It is noted that the embodiment of the dentifrice material dispensing and refilling system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A dispensing and refilling system for dispensing and refilling dentifrice material comprising:

a dispensing toothbrush having a hollow cavity; and a refilling apparatus for refilling the dentifrice material in said dispensing toothbrush comprising:

a dentifrice material reservoir for housing therein said dentifrice material, a nozzle detachably coupled to said dentifrice material reservoir, and a pumping assembly for applying a force of pressure to said dentifrice material, wherein as said force of pressure is applied to said dentifrice material, said dentifrice material exits refilling apparatus and enters said hollow cavity;

said dispensing toothbrush further including a toothbrush head having a plurality of bristles coupled thereto and a plurality of dispensing apertures formed therein, a means for dispensing dentifrice material, and a means for compressing dentifrice material;

said means for dispensing dentifrice material comprising a bladder-type posh-button having an air hole formed therein.

* * * * *